US008024966B2

(12) United States Patent
Fu

(10) Patent No.: US 8,024,966 B2
(45) Date of Patent: Sep. 27, 2011

(54) TEST SETUP FOR A HIGH-SPEED-TORPEDO DEFENSE SYSTEM

(75) Inventor: Jyun-Horng Fu, Centreville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 474 days.

(21) Appl. No.: 12/051,643

(22) Filed: Mar. 19, 2008

(65) Prior Publication Data

US 2009/0217750 A1 Sep. 3, 2009

Related U.S. Application Data

(60) Provisional application No. 60/908,679, filed on Mar. 29, 2007.

(51) Int. Cl.
*G01L 5/14* (2006.01)

(52) U.S. Cl. ..... 73/167; 42/1.14; 114/316

(58) Field of Classification Search ..... 73/167; 42/1.14; 114/316, 319
See application file for complete search history.

(56) References Cited

U.S. PATENT DOCUMENTS 4,523,538 A * 6/1985 Hollmann et al. ..... 114/238
5,503,099 A * 4/1996 Peterson ..... 114/253
5,639,982 A * 6/1997 Cipolla ..... 89/1.11

* cited by examiner

*Primary Examiner* — Stephen M Johnson
(74) *Attorney, Agent, or Firm* — DeMont & Breyer, LLC

(57) ABSTRACT

A test system that is capable of evaluating the effectiveness of a weapons system designed to defeat an incoming, fast-moving, underwater munition is disclosed. In the illustrative embodiment, an extremely large tubular sheath is inflated underwater. The sheath is maintained at a depth and inclination that is appropriate for an incoming torpedo. An inert projectile is launched or flown inside the sheath at a speed that is consistent with the speed of munition that the weapons system is intended to defeat.

13 Claims, 4 Drawing Sheets

TEST SETUP FOR A HIGH-SPEED-TORPEDO DEFENSE SYSTEM

CROSS REFERENCE TO RELATED APPLICATIONS

This case claims priority of U.S. Provisional Patent Application U.S. 60/908,679, which is incorporated by reference herein.

FIELD OF THE INVENTION

The present invention relates to weapon systems in general, and, more particularly, to a system for testing a weapons system.

BACKGROUND OF THE INVENTION

The Shkval is a high-speed, supercavitating, rocket-propelled torpedo developed by Russia. It was designed to be a rapid-reaction defense against U.S. submarines undetected by sonar. It can also be used as a countermeasure to an incoming torpedo, forcing the hostile projectile to abruptly change course and possibly break its guidance wires.

The solid-rocket propelled torpedo achieves a high velocity of 250 knots (288 mph) by producing an envelope of supercavitating bubbles from its nose and skin, which coat the entire weapon surface in a thin layer of gas. This causes the metal skin of the weapon to avoid contact with the water, significantly reducing drag and friction.

The Shkval is fired from the standard 533-mm torpedo tube at a depth of up to 328 ft (100 m). The rocket-powered torpedo exits the tube at 50 knots (93 kmh) and then ignites the rocket motor, propelling the weapon to speeds four to five times faster than other conventional torpedoes. The weapon reportedly has an 80 percent kill probability at a range of 7,655 yd (7,000 m).

The torpedo is guided by an autopilot rather than by a homing head as on most torpedoes. Reportedly, there is a homing version of the Shkval that starts at the higher speed but slows and enters a search mode.

Notwithstanding its defense-motivated origins, the Shkval is potentially a very significant offensive threat. To defeat such a torpedo, a surface ship deck-launched anti-torpedo must be capable of (1) brief but stable flight, (2) entering the water at a low grazing angle, and (3) sustaining a supercavitating running mode under water.

There are no torpedo vehicles available that are capable of approaching the Shkval's speed. It is not possible, therefore, to access the feasibility of any anti-Shkval weapon system to a reasonable level of confidence. Consequently, there is a need for a test set-up that can act as a surrogate for an attacking Shkval torpedo, so that an anti-Shkval weapon system can be developed and tested.

SUMMARY OF THE INVENTION

The present invention provides a test system that is capable of evaluating the effectiveness of an anti-Shkval weapon system or other weapons system designed to defeat an incoming, very fast-moving, underwater munition.

In the illustrative embodiment, an extremely large tubular sheath is inflated underwater. The sheath, which is effectively a "balloon," is maintained at a depth and inclination that is appropriate for an incoming torpedo. An inert projectile is flown/propelled inside the sheath at the speed of a Shkval torpedo—250 knots.

The sheath must be large enough in diameter to accommodate at least a minimal amount of projectile maneuvering. And the sheath must be long enough to provide for an expected amount of travel based on the projectile's speed and the time it is likely to take for the defensive system to "acquire" and destroy the projectile. A sheath having a diameter (inflated) that is in the range of about 5 to 15 meters and a length (inflated) that is in the range of about 50 to 500 meters should be adequate, as a function of the specific aspects of the anti-weapon that are being tested.

The sheath must of course be sufficiently pressurized to resist water pressure, as a function of its depth under water. In some embodiments in which the projectile is missile (i.e., self-powered), the sheath is reinforced at the region where the missile initially fires, to accommodate the heat and erosive exhaust is generated.

The sheath, projectile, or both can be appropriately painted to simulate the reflectivity of a Shkval, as influenced by the supercavitating bubbles that would be shrouding it in its supercavitating running mode. Alternatively, the air can be colored or misted for the same purpose.

DETAILED DESCRIPTION

Figure 1:
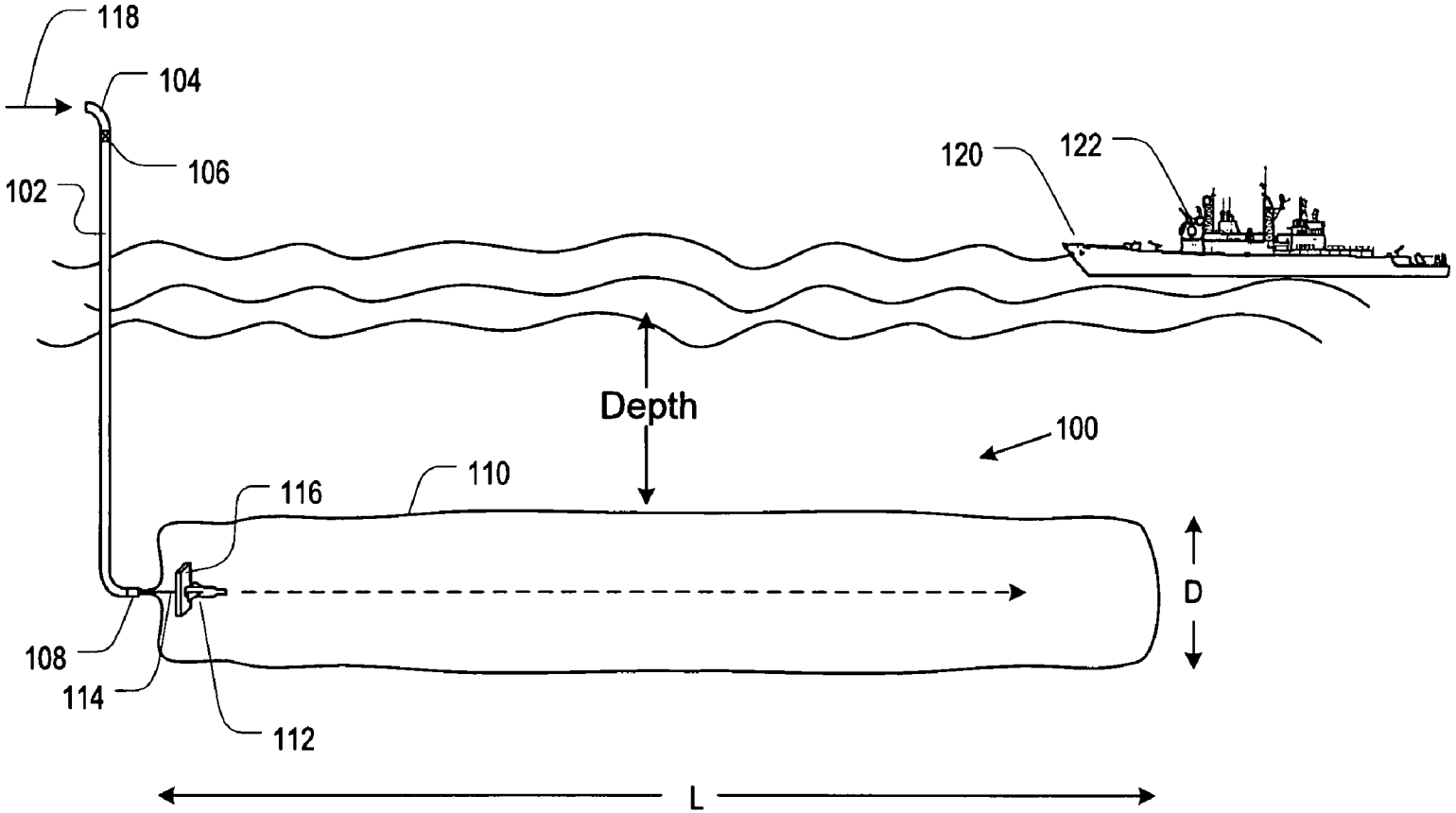
FIG. 1 depicts a diagram of a test system in accordance with the illustrative embodiment of the present invention.

FIG. 1 depicts a diagram of test system 100 in accordance with the illustrative embodiment of the present invention. The test system can be located in a large and sufficiently deep pond or tank, or in a natural water way, as appropriate. In the illustrative embodiment, test system 100 is used to test a ship-mounted high-speed-torpedo defense system, such as system 122, which is located on vessel 120.

In the illustrative embodiment, system 100 includes gas supply line 102, sheath 110, and inert projectile 112. Gas supply line 102 is partially submerged; gas intake 104 is above the water line and gas discharge 108 is below the water line. Gas supply line 102 is supported in an appropriate fashion (e.g., from above, from below, etc.).

Gas intake 104 of the gas supply line receives flow 118 of gas (e.g., air, nitrogen, etc.). In some embodiments, the gas as supplied is appropriately pressurized. In some other embodiments, gas supply line 102 includes an inline gas compressor (not shown). The inline gas compressor draws gas (e.g., air, etc.) into gas intake 104, compresses the gas, and then directs it toward gas discharge 108. Some embodiments will receive gas from a pressurized source and then pressurize it further via an inline compressor.

Control valve 106 controls flow 118 of gas through supply line 102. In some embodiments, control valve 106 is remotely controlled. Control valve 106 is meant to be representative of what is more likely to be an arrangement of valves (e.g., check valves, flow control valves, etc.) for controlling the flow of gas through supply line 102.

Sheath 110 is coupled, via a gas-tight connection, to gas discharge 108 of gas supply line 102. The sheath is a non-porous bag, typically flexible, that is suitable for inflation with a gas. Effectively, sheath 110 is a very long, tube-shaped balloon.

Flow 118 of compressed gas exits gas discharge 108 of gas supply line 102 and inflates sheath 110.

Supported within sheath 110 is projectile 112. The projectile is inert; in other words, it does not carry a munitions payload. Projectile 112 is supported by support 114, which in the illustrative embodiment, is coupled to gas supply line 102.

Projectile 112 can be self-powered (e.g., a missile, etc.), or it can be ejected (e.g., launched via an auxiliary power source). To the extent that projectile 112 is self-powered, shield 116 is advantageously employed to protect sheath 110 from hot exhaust gases. Furthermore, in some embodiments, sheath 110 is reinforced and appropriately lined, proximal to the launch location, with a heat- and abrasion-resistant material. Once launched, projectile 112 proceeds through sheath 110.

Sheath 110 must be large enough in diameter to accommodate at least a minimal amount of projectile maneuvering. To that end, diameter D of the inflated sheath is typically in a range of about 5 to 15 meters. Furthermore, the sheath must be long enough to provide for an expected amount of travel based on the speed of projectile 112 speed and the time it is likely to take for the defensive system to "acquire" and, as appropriate, destroy the projectile. Length L of the sheath is typically in a range of about 50 to 500 meters, as a function of the specific aspects of the anti-weapon that are being tested (e.g., target acquisition or target acquisition and neutralization, etc.).

To serve as a useful test bed, sheath 110 should be situated underwater at an appropriate depth. That depth will typically be 100 meters or less.

In most instances, a torpedo will be fired from a depth that is greater than that of its target. In other words, the torpedo will rise from its launch depth to a target depth. As a consequence, it is advantageous to control the inclination of sheath 110 to permit projectile 112 to follow a typically inclined trajectory.

Figure 2:
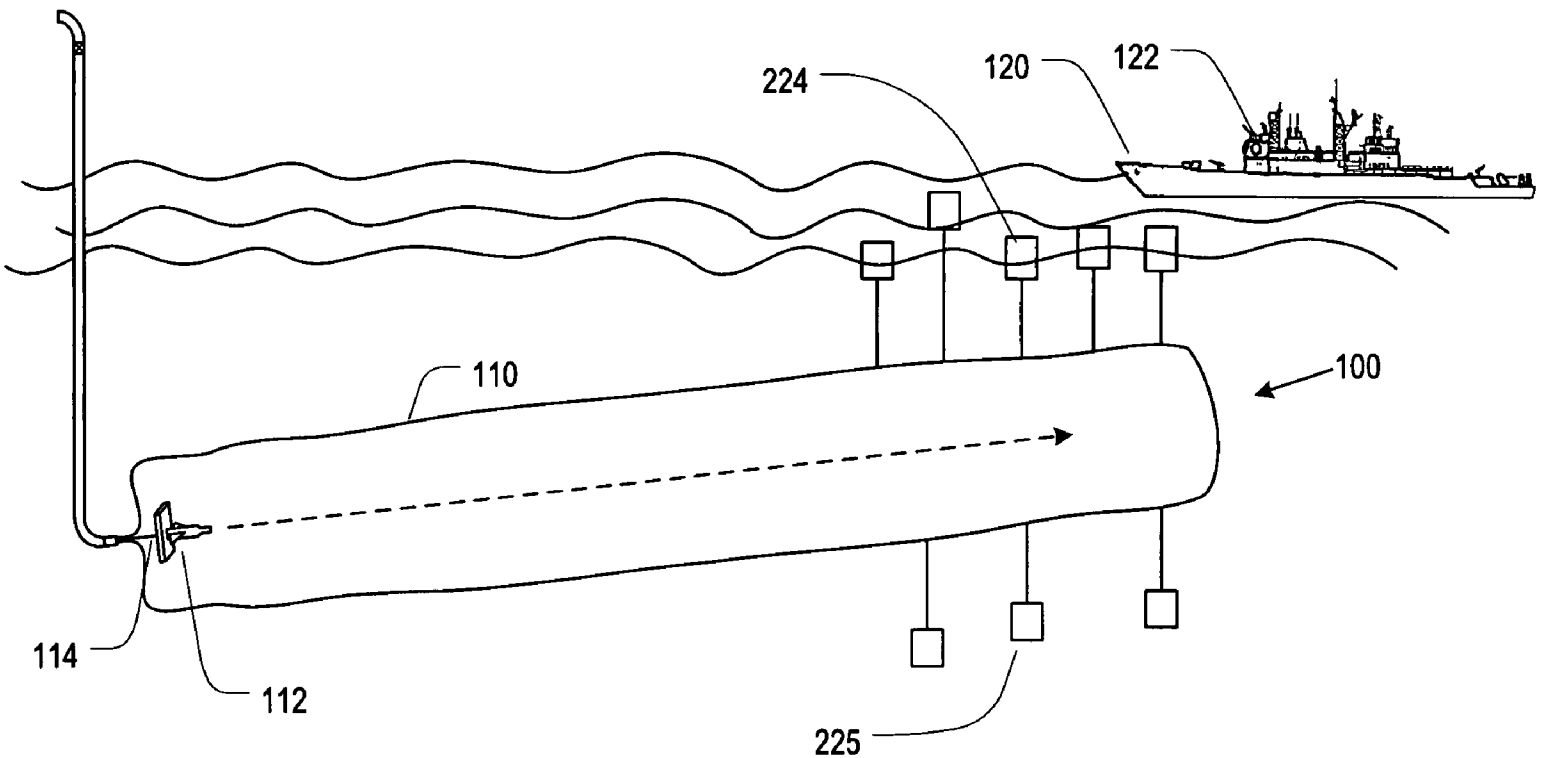
FIG. 2 depicts a further embodiment of the test system of FIG. 1, wherein floats and/or weights are used to adjust the inclination of the sheath.

Sheath 110 is depicted in a horizontal attitude in FIG. 1. Actually, it's free end would typically rise higher in the water than the fixed end (located at discharge 108), since the sheath is filled with gas and is less dense than the water. The inclination of sheath 110 can be controlled using floats 224 and weights 225, as depicted in FIG. 2. Any desired inclination/declination can be provided with an appropriate selection of floats and weights.

In some embodiments, ribs (not depicted), are positioned along the length of sheath 110. The ribs provide rigidity to inflated sheath 110 to help maintain an elongated cylindrical shape.

Figure 3:
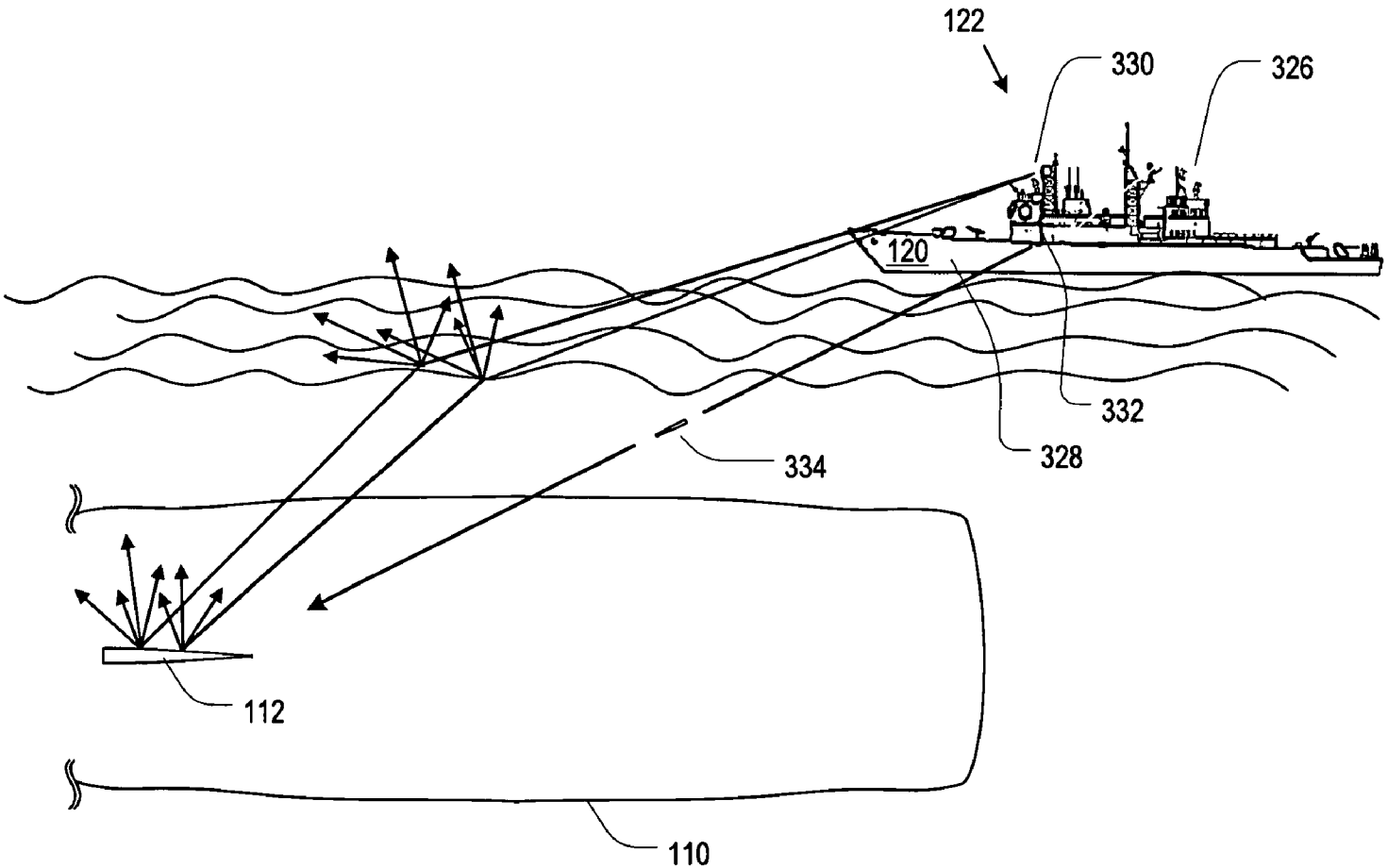
FIG. 3 depicts an example in which a proposed anti-supercavitating torpedo weapon system is tested via the test system of FIG. 1.

FIG. 3 depicts test system 100 being used to test ship-mounted high-speed-torpedo defense system 122 aboard vessel 120. The high-speed torpedo-defense system integrates several conventional technologies via a command and control system. The control system coordinates the activities of these various technologies to acquire and destroy a rocket-propelled or other high-speed torpedo.

Figure 4:
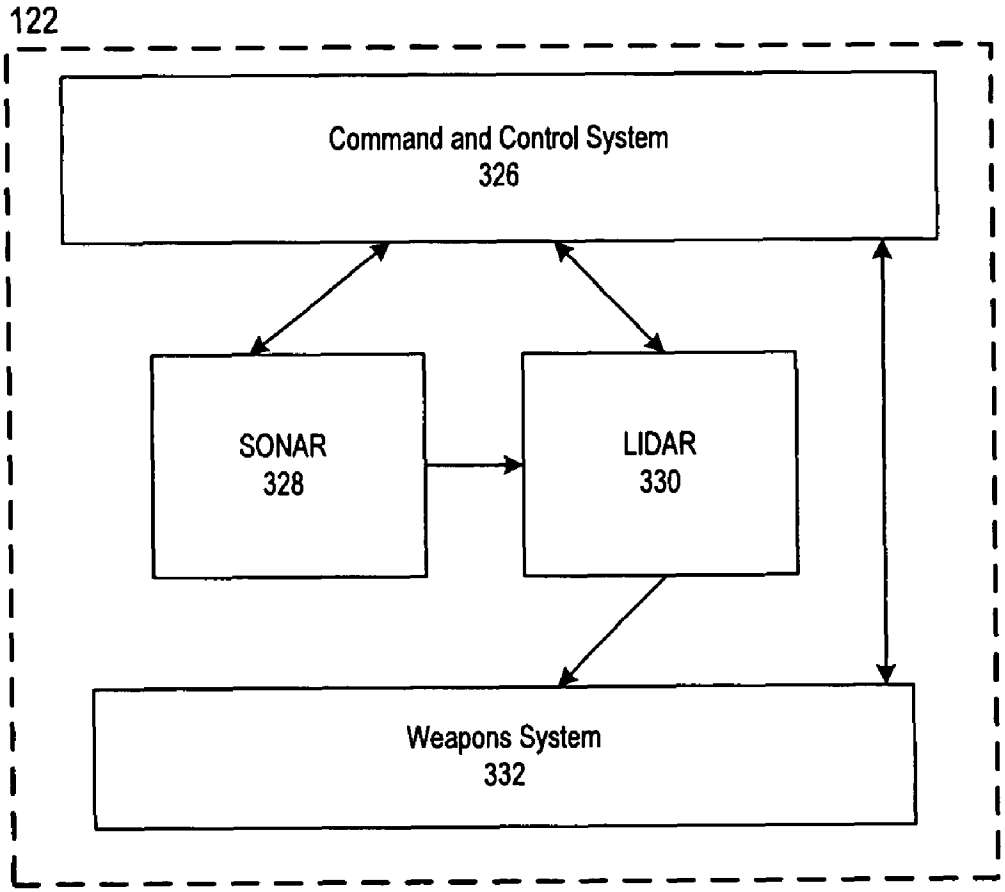
FIG. 4 depicts a block diagram of the weapon system of FIG. 2.

Torpedo defense system 122, which is not a part of test system 100, includes command and control system 326, SONAR 328, LIDAR 330, and weapons system 334. See also FIG. 4, depicting the flow of communications and information between the various elements of high-speed torpedo defense system.

Command and control system ("CCS") 326 coordinates the activities of and provides processing for the constituent systems (SONAR 328, LIDAR 330, and weapons system 332). More particularly, CCS 326 coordinates initial detection, via SONAR, which provides the torpedo's bearing to about +/− one degree. The CCS also coordinates hand-off to LIDAR 330 for high resolution bearing and ranging. Furthermore, CCS 326 coordinates weapons system 332, under the control of LIDAR 330.

CCS 326 comprises one or more processors. Due to the rapid response time required to acquire and destroy a high-speed torpedo (i.e., about 5 seconds), CCS 326 operates with relative autonomy. CCS 326 does require operator interaction for initialization, system troubleshooting, training, and support. In some embodiments, CCS 326 includes redundant hardware that is disposed in several locations aboard ship to improve the survivability of system 122.

SONAR system 328 comprises conventional passive SONAR, active SONAR, or both. In some embodiments, the SONAR system is modified to provide higher-frequency detection for increased resolution by reducing the spacing of hydrophones in the SONAR array. CCS 326 supports the operation of SONAR 328 by performing data processing for passive SONAR (e.g., beamforming, classification, track, etc.) to develop the initial detection and bearing information relative to the frame of reference for the other systems (e.g., LIDAR 330 and weapons 332. CCS 326 also controls active SONAR with information for waveforms, source level, and other acoustic parameters that are required for proper operation.

LIDAR 330 is a conventional light detection and ranging system for ranging and tracking. It typically utilizes a high-power pulsed laser system. CCS 326 provides LIDAR 330 with control data for operation and aiming. Further, CCS 326 takes the optical data from LIDAR receivers and develops high-resolution track information relative to the gun frame of reference.

Weapons system 332 comprises one or more rotary guns (e.g., a gatling gun, etc.) or reciprocating guns. In some embodiments, the gun fires low-grazing angle, supercavitating projectiles, such as projectile 336. CCS 326 develops gun control information that will properly lead the gun to fire projectiles where the target will be when the projectiles travel to that volume. The software for CCS 326 accounts for any translation impacts due to ship movement, including mast motions, gun recoils, gun inertial, ship movement due to weather, etc.

In operation of test system 100 to evaluate the efficacy of high-speed torpedo defense system 122, projectile 112 is launched/fired. SONAR 328 of defense system 122 detects (or, if ineffective, does not detect) the launch of projectile 112 and determines bearing and approximate range. Bearing accuracy is about +/− one degree.

SONAR 328 hands over bearing and range to LIDAR 330, which places an initial range "gate" in a fixed position at approximately a standoff range. In an actual encounter, the gate would be at about 1000 yards. But in the context of test system 100, the gate is suitably adjusted to meet the limitations (reduced size scale) of test system 100.

When projectile 112 breaches the gate, LIDAR 330 initiates tracking of the torpedo, determining its position in angle-angle range space. LIDAR 330 then hands this information over to weapons system 332. More particularly, the information from LIDAR 330 is used to position the guns to an initial pointing position, positioning the gun at the exact firing point to provide a high probability of projectile impact with the incoming projectile 112.

In an actual attack scenario, weapons system 332 would open fire at about 500 meters. This distance is suitably adjusted for the reduced size scale of test system 100. In some embodiments, projectiles are not fired from weapons system 332 toward test system 100. In some other embodiments, projectiles 334 are fired from weapons system 332, which will damage or destroy sheath 110. In some embodiments, projectiles 334 from the deck launcher are preferably cavity-running, delayed-ignition, high-explosive projectiles. The projectiles are designed to enter the water at low grazing angles, and enter into a cavity-running or super-cavitation mode. On impact with the torpedo, a delayed ignition system detonates a high-explosive fill.

The performance of the high-speed-torpedo defense system is evaluated based on target acquisition time and other performance measures.

What is claimed is:

1. An apparatus that, in use, is disposed at least partially under water, comprising:

an elongated, transparent, non-porous sheath, wherein the sheath is inflatable by filling with a pressurized gas;

a gas supply conduit, wherein a discharge end of gas supply conduit and said sheath are coupled to one another via a gas-tight seal; and a projectile disposed within the sheath, wherein, when the sheath is inflated and the projectile is launched, the projectile travels within the sheath.

2. The apparatus of claim 1 wherein the sheath is flexible.

3. The apparatus of claim 1 wherein the projectile is a missile.

4. The apparatus of claim 1 wherein the projectile does not include a power source.

5. The apparatus of claim 1 wherein the sheath has a diameter that is in a range of about 5 meters to about 15 meters.

6. The apparatus of claim 1 wherein the sheath has a length that is in a range of about 50 meters to about 500 meters.

7. The apparatus of claim 1 wherein the projectile travels at a speed or scale speed in excess of 200 knots.

8. The apparatus of claim 1 wherein the gas is air.

9. The apparatus of claim 1 further comprising a remote control system for controlling a flow of gas through the gas supply conduit.

10. The apparatus of claim 1 further comprising a float attached to the sheath.

11. The apparatus of claim 1 further comprising a weight attached to the sheath.

12. The apparatus of claim 1 further comprising ribs that are coupled to the sheath.

13. An apparatus that is disposed at least partially under water when in use, wherein the apparatus comprises:

an elongated, transparent, non-porous sheath, wherein the bag is inflatable by filling with gas, and wherein the bag is at least 50 meters in length;

a gas supply conduit, wherein a first end of said sheath is coupled to a discharge end of said gas supply conduit; and a projectile disposed within the sheath.

* * * * *